US012628890B2

(12) United States Patent
Phillips

(10) Patent No.: US 12,628,890 B2
(45) Date of Patent: May 19, 2026

(54) GLOVE PROVIDING ENHANCED SELECTION AND MANIPULATION CAPABILITIES

(71) Applicant: FLORIDA INSTITUTE FOR HUMAN AND MACHINE COGNITION INC., Pensacola, FL (US)

(72) Inventor: Jeff Phillips, Lillian, AL (US)

(73) Assignee: FLORIDA INSTITUTE FOR HUMAN AND MACHINE COGNITION, INC., Pensacola, FL (US)

( * ) Notice: Subject to any disclaimer, the term of this patent is extended or adjusted under 35 U.S.C. 154(b) by 0 days.

(21) Appl. No.: 18/817,801

(22) Filed: Aug. 28, 2024

(65) Prior Publication Data

US 2024/0415214 A1 Dec. 19, 2024

Related U.S. Application Data

(63) Continuation-in-part of application No. 18/124,093, filed on Mar. 21, 2023.

(51) Int. Cl.
*A41D 19/00* (2006.01)
*G06F 3/01* (2006.01)

(52) U.S. Cl.
CPC ..... *A41D 19/0027* (2013.01); *A41D 19/0006* (2013.01)

(58) Field of Classification Search
CPC ..... A41D 19/0024; G06F 3/016
See application file for complete search history.

(56) References Cited

U.S. PATENT DOCUMENTS 5,631,861 A * 5/1997 Kramer ..... G06F 3/016 703/7
6,128,004 A 10/2000 McDowall et al.
6,141,643 A 10/2000 Harmon
7,874,021 B2 1/2011 Sunder et al.
9,104,271 B1 8/2015 Adams et al.
10,485,280 B1 * 11/2019 DePriest ..... G06F 3/0393
(Continued)

OTHER PUBLICATIONS

Refrigiwear, "Extreme Freezer Glove with Touch-Rite Nib", webpage, https://refrigiwear.com/product/extreme-freezer-glove-with-touch-rite-nib/.

*Primary Examiner* — Tadesse Hailu
(74) *Attorney, Agent, or Firm* — Jacob M. Ward; Ward Law Office LLC

(57) ABSTRACT

A glove that enhances a user's ability to sense the details of external objects and to interact with external objects. One or more tactile nodes are provided on the glove. Each tactile node incorporates an attached rod oriented approximately perpendicular to the outer surface of the glove. The rod extends through to the interior of the glove—where it ends in a finger interface. When an external object pushes against the node's exterior surface, the rod is translated inward (moving in a direction that is roughly perpendicular to the exterior surface) and the finger interface cap protrudes beyond the glove's inner surface and presses against the user's finger. The small point of contact made by the finger interface cap enhances the user's ability to detect the external object. An array of such tactile nodes are preferably provided.

20 Claims, 14 Drawing Sheets

(56) References Cited

U.S. PATENT DOCUMENTS

| | | | | |
|---|---|---|---|---|
| 2005/0231471 | A1* | 10/2005 | Mallard | A41D 19/0024 345/156 |
| 2006/0221066 | A1 | 10/2006 | Cascella | |
| 2007/0245454 | A1 | 10/2007 | Eklund | |
| 2008/0297493 | A1 | 12/2008 | Adkins | |
| 2009/0000010 | A1 | 1/2009 | Sunder et al. | |
| 2009/0183297 | A1 | 7/2009 | Drosihn | |
| 2010/0090966 | A1 | 4/2010 | Gregorio | |
| 2011/0016609 | A1 | 1/2011 | Phelps et al. | |
| 2012/0042437 | A1* | 2/2012 | Matthews | A41D 19/0024 2/160 |
| 2012/0159689 | A1 | 6/2012 | Jiang et al. | |
| 2013/0036529 | A1 | 2/2013 | Salter et al. | |
| 2013/0180027 | A1* | 7/2013 | Rock | A41D 19/0024 2/167 |
| 2013/0207900 | A1 | 8/2013 | Harooni | |
| 2014/0165262 | A1* | 6/2014 | Klausner | G06F 3/0393 2/167 |
| 2014/0176452 | A1* | 6/2014 | Aleksov | G06F 3/04812 345/173 |
| 2015/0289575 | A1 | 10/2015 | Krautner | |
| 2016/0033238 | A1 | 2/2016 | Cooper | |
| 2016/0161301 | A1* | 6/2016 | Guenther | G07C 1/00 702/150 |
| 2017/0295867 | A1 | 10/2017 | Smith | |
| 2018/0303175 | A1* | 10/2018 | Lim | A41D 19/01523 |
| 2020/0174566 | A1 | 6/2020 | Klein et al. | |
| 2020/0195042 | A1* | 6/2020 | Topolosky | A41D 1/005 |
| 2020/0249756 | A1 | 8/2020 | Straza, II | |
| 2021/0386145 | A1 | 12/2021 | Dong et al. | |

* cited by examiner

GLOVE PROVIDING ENHANCED SELECTION AND MANIPULATION CAPABILITIES

CROSS-REFERENCES TO RELATED APPLICATIONS

This non-provisional patent application is a continuation-in-part of U.S. patent application Ser. No. 18/124,093. The parent application was filed on Mar. 21, 2023. The parent application listed the same inventor.

STATEMENT REGARDING FEDERALLY SPONSORED RESEARCH OR DEVELOPMENT

Not applicable

MICROFICHE APPENDIX

Not applicable

BACKGROUND OF THE INVENTION

1. Field of the Invention

This invention relates to the field of clothing. More specifically, the invention comprises a glove incorporating enhanced selection and manipulation capabilities.

2. Description of the Related Art

Protective clothing is used in a wide variety of fields. Flight gloves used by military pilots provide a good example. Such gloves provide protection against cold conditions and—perhaps most significantly—fire. FIG. 1 provides a perspective view of a prior art glove 10. Gloves are made in many different ways. A common approach is to use a flat back trank joined to a flat palm trank via a ribbon of interconnecting material known as a fourchette. In the example of FIG. 1, back trank 14 is made of NOMEX (a meta-aramid polymer). NOMEX is often used because it combines flexibility and breathability with flame resistance.

Fourchette 20 is also made of NOMEX, but with an additional elasticizing element in the weave so that a higher degree of stretching is created. The version shown has a posterior extended fourchette 22. This allows increased radial elasticity for the glove. Thumb 24 is a separate component that is also stitched to fourchette 20. Cuff cinch 12 has a hook-and-loop tab that allows the cuff to be tightened.

The fourchette and trank materials often have different desired characteristics. For example, the trank material 14 might be selected primarily for breathability, whereas the fourchette material 18 might be selected primarily for abrasion resistance. The present invention can be utilized with virtually any combination.

FIG. 2 shows the same glove from the palm side. Palm trank 26 includes a high-friction coating. In this example a layer of rubber is bonded to a layer of NOMEX. The high-friction coating enhances grip. The reader in this view may see how fourchette 20 wraps around the four fingers and joins the back trank to the palm trank.

Such gloves protect the user's hands and this is obviously desirable. However, the gloves also reduce the user's ability to feel objects and manipulate external components requiring dexterity. Many user interfaces now include capacitive touch screens. These screens allow a user to move a cursor by touching the screen with a fingertip and then moving the fingertip across the screen. Selections are made by pressing or tapping the finger against the screen. The detection of a selection or "pick" may be done by a resistive layer in the touchscreen. The resistive layer actually deforms to create a bridge circuit in the area of the pick. In more recent years, a user selection is often detected using raw position data fed through a software algorithm. The software actually detects the pick when a short-duration contact is detected over an icon display (as one example). In other cases a pick is detected when the pressing action broadens the contact point and this produces a change in the electrostatic field of a transparent conductor which is sensed and interpreted as a user "button push" or "pick" by the software associated with the touch screen.

The use of capacitive touch screen devices is impaired by the wearing of fabric gloves, since the fabric provides an insulating layer between the user's skin and the screen. FIG. 2 shows a prior art solution to this problem. Conductive patch 28 is included in the fourchette proximate the user's fingertip. This conductive patch is created by including a conducting fiber in the fabric weave. A separate patch of conductive cloth is often used (rather than including a conductive fiber in the entire glove) because the inclusion of the conductive fiber significantly increases the fabric cost.

The use of conductive patch 28 allows the user to move a cursor on a touchscreen device and also allows the user to make a selection by pressing (a software-registered "pick"). However, the moving and selection actions are quite clumsy compared to the user's bare fingertip. The lack of tactile feedback makes it difficult for the use to know how hard he or she is pressing. A light amount of pressure may cause the fabric of conductive patch 28 to flatten against the screen-causing the interface device to register a "pick" when no pick was intended. It is difficult for the user to accurately feel the pressure as he or she moves a finger around on the screen.

The wearing of gloves also (1) reduces a user's sensory contact with objects in the user's environment, and (2) prevents the use of a user's fingernails to engage objects. The present invention provides a new type of glove that addresses these problems.

BRIEF SUMMARY OF THE INVENTION

The present invention comprises a glove that enhance a user's ability to sense the details of external objects and to interact with external objects. One or more tactile nodes are provided on the glove. Each tactile node incorporates an attached rod oriented approximately perpendicular to the outer surface of the glove. The rod extends through to the interior of the glove—where it ends in a finger interface. When an external object pushes against the node's exterior surface, the rod is translated inward (moving in a direction that is roughly perpendicular to the exterior surface) and the finger interface protrudes beyond the glove's inner surface and presses against the user's finger.

The small point of contact made by the finger interface enhances the user's ability to detect the external object. An array of such tactile nodes are preferably provided. The array is preferably placed in a region where enhanced perception is desired-such as proximate a fingertip. When an external object bears against the array the user receives multiple contact points from multiple finger interface caps-thereby providing enhanced tactile information to the user through the glove.

The insert can contain additional features allowing the user to interact with external objects. A tactile touchscreen selector can be provided so that the user can interact with a touchscreen while wearing the glove. A nail protrusion can also be provided, with this feature providing a function similar to a human fingernail.

REFERENCE NUMERALS IN THE DRAWINGS

Figure 1:
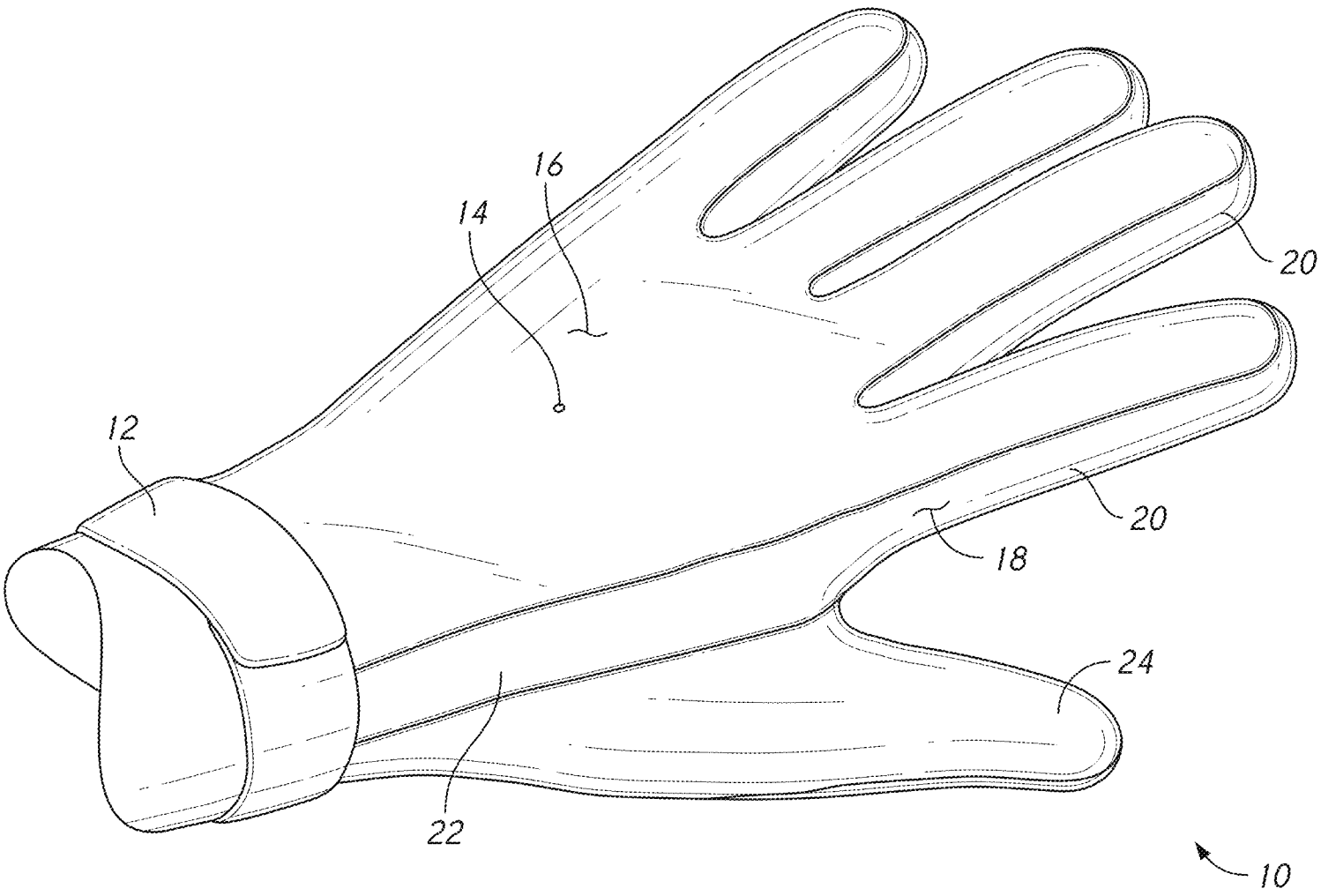
FIG. 1 (PRIOR ART)
FIG. 1 is a perspective view, showing a prior art glove.
Figure 2:
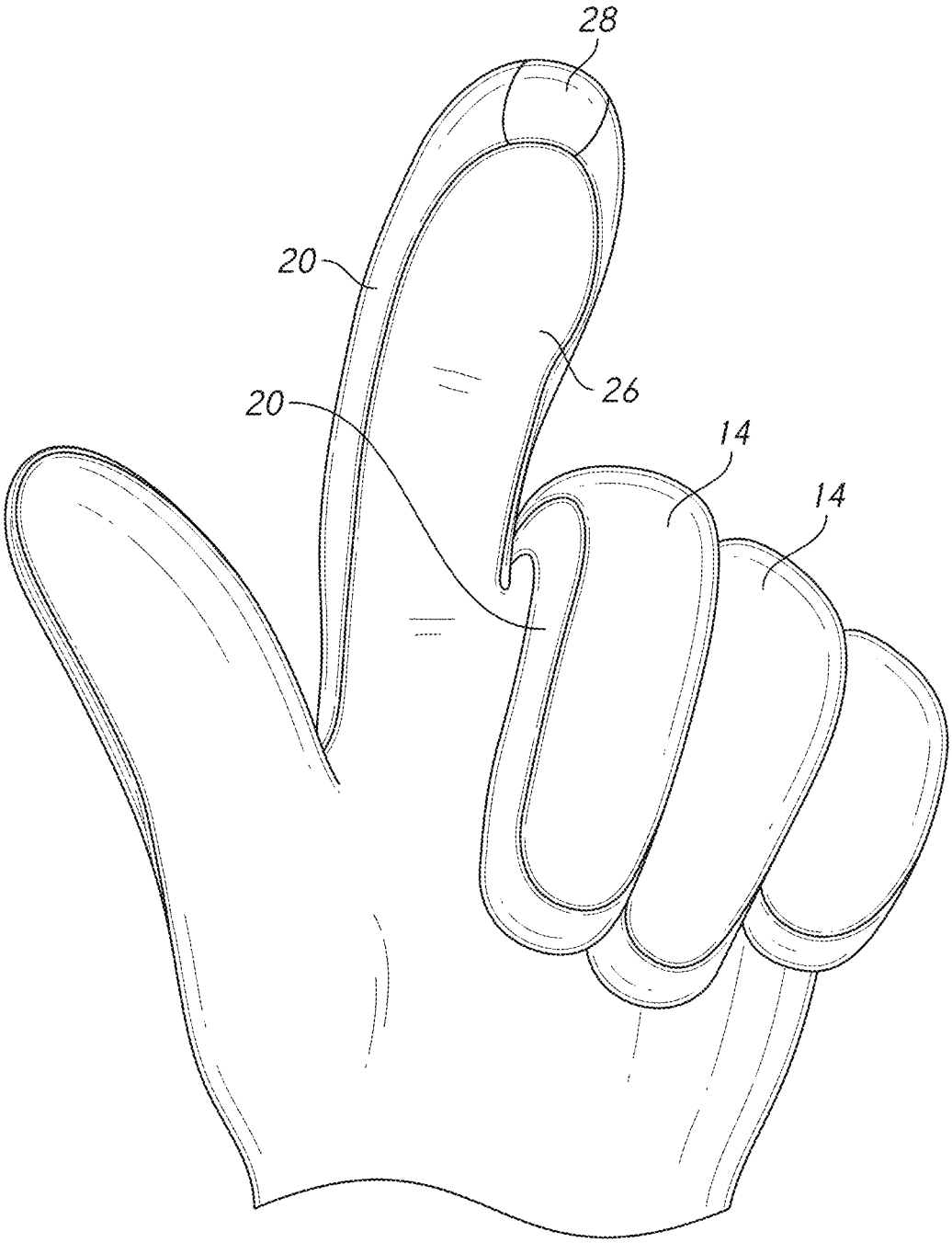
FIG. 2 (PRIOR ART)
FIG. 2 is a perspective view, showing the glove of FIG. 1 from a different vantage point.

10 glove
12 cuff cinch
14 back trank
16 trank material
18 fourchette material
20 fourchette
22 posterior extended fourchette
24 thumb
26 palm trank
28 conductive patch
30 fingertip region
32 tactile touchscreen selector
34 conductive mesh
36 plunger
38 resilient collar
40 housing
42 fingertip
44 tactile surface
46 base
48 flange
50 touch screen
52 glove
54 icon
56 tactile indicator
58 overhanging portion
60 tip
62 first finger insert
63 wall
64 second finger insert
66 thumb insert
68 node
70 outer layer
72 inner layer
74 attachment flange
76 upper portion
78 tip portion
80 lower portion
82 nail protrusion
84 rod
86 surface interface cap
88 finger interface cap
90 relief
92 outer layer
94 second layer
96 third layer
98 inner layer
100 inner surface
102 object
104 outer surface

DETAILED DESCRIPTION OF THE INVENTION

Figure 3:
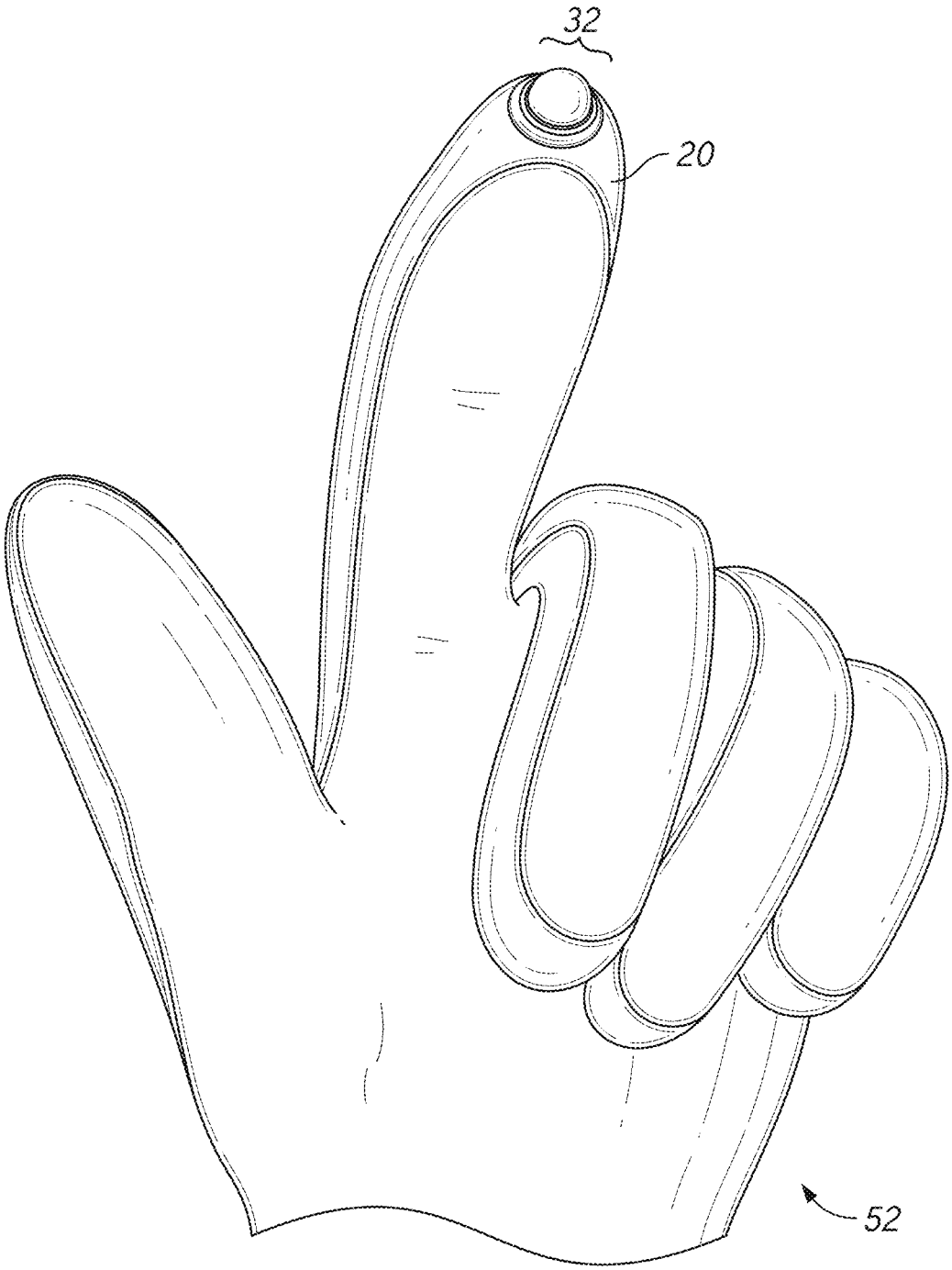
FIG. 3 is a perspective view, showing a glove that incorporates the present invention.

FIG. 3 shows glove 52 incorporating a stand-alone tactile touchscreen selector 32 in fingertip region 30. The tactile touchscreen selector can be added as part of an inventive insert or provided as a stand-alone component. This device will most often be placed in an area that is commonly used for interacting with a touchscreen device. Hence, in the version shown, the selector is placed near the tip of the index finger.

Figure 4:
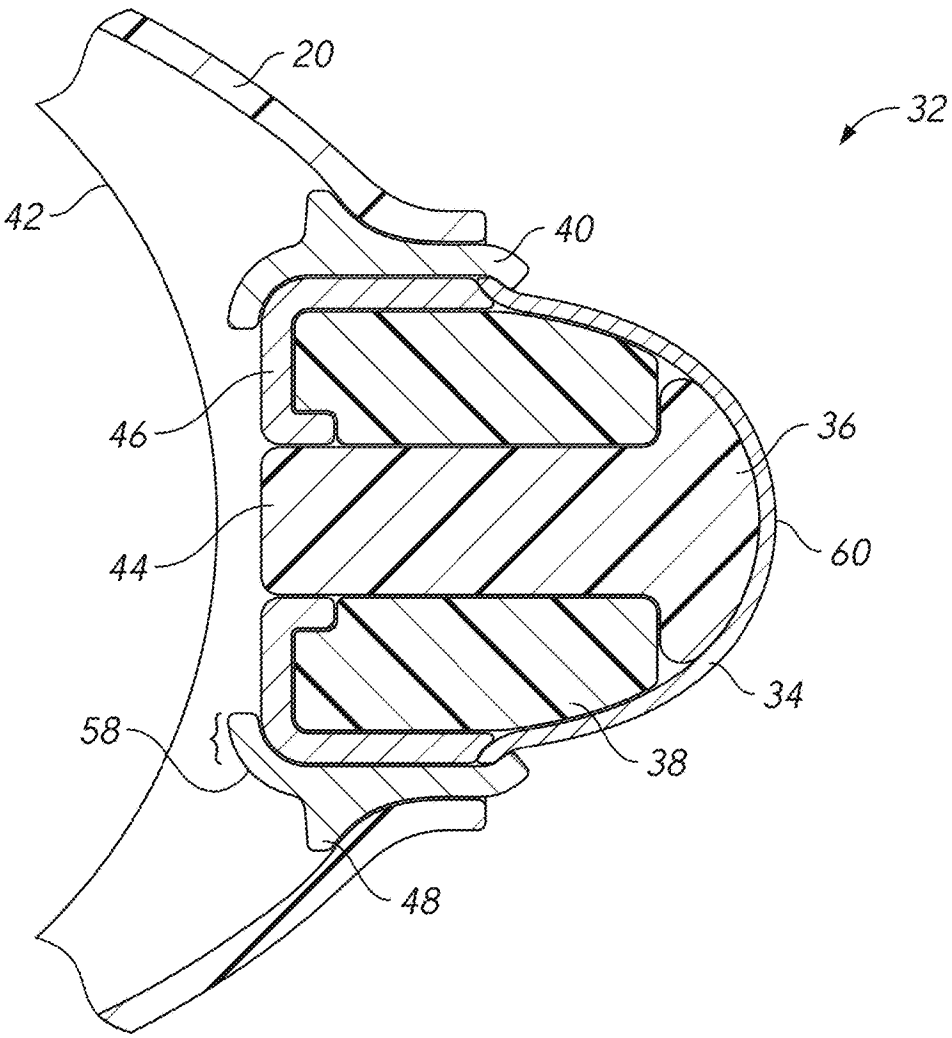
FIG. 4 is a sectional view, showing internal details of an embodiment of the invention.
Figure 5:
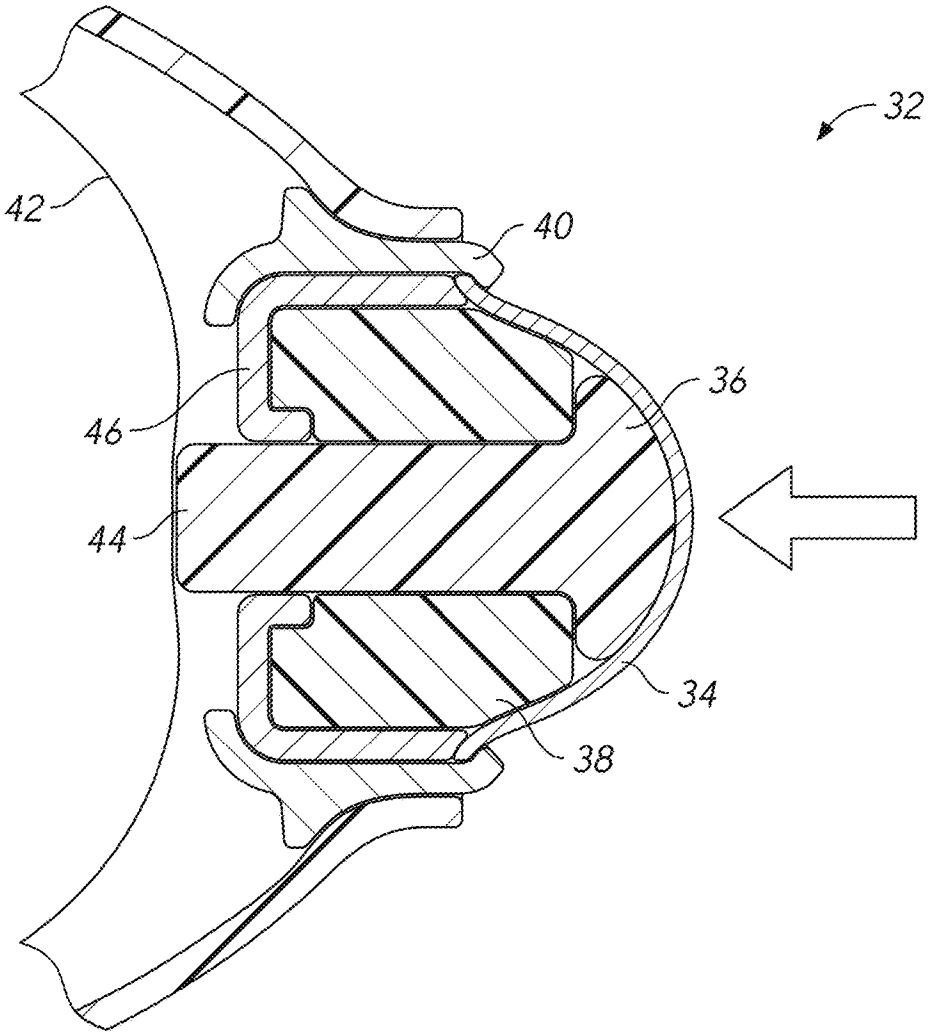
FIG. 5 is a sectional view, showing the embodiment of FIG. 4 when it is pressed against a surface.

FIGS. 4 and 5 provide a sectional view through an embodiment of the tactile touchscreen selector. In this example tactile touchscreen selector 32 is placed in a hole through fourchette 20—proximate the location of fingertip 42. Conductive mesh 34 is a flexible layer including conductive fibers. The mesh has a dome shape, with the tip 60 of the dome being on the right side of the view. Components of the assembly will be referred to as increasingly distal from this tip as one proceeds to the left in the orientation of the view. Thus, proximal in this context will mean further to the right and distal will mean further to the left.

The mesh has low electrical resistance across its thickness. Plunger 36 rests immediately behind the conductive mesh. An expanded section of the plunger contacts the back surface of conductive mesh 36. The body of the plunder assumes the form of a cylinder in this example. The portion of the plunger most distal to conductive mesh 34 is tactile surface 44.

The components are contained within housing 40. Overhanging portion 58 of housing 40 is shown in its final state—after it has been swaged over base 46. When the device is originally being assembled, overhanging portion 58 is straight. This allows conductive mesh 34 to be placed inside the housing, followed by plunger 36, resilient collar 38, and finally base 46. Once the components are assembled, they are placed in a holding fixture and overhanging portion 58 of housing 40 is swaged over the distal portion of base 46.

With the swaging operation, the outer perimeter of conductive mesh 34 is pinched between the proximal portion of housing 40 and the proximal portion of base 46. This action secures the conductive mesh in place. Base 46 is "captured" in position by the swaging operation that creates overhanging portion 58. Resilient collar 38 in this example is a compressible foam. It is somewhat compressed by the swaging operation so that conductive mesh 34 is maintained in tension. The resilient collar tends to urge plunger 36 to the right in the view. Many different spring elements (defined as anything tending to urge the plunger toward the tip of the conductive mesh) could be used for this purpose. As one example, a compression spring surrounding the cylindrical portion of plunger 36 could substitute for resilient collar 38 and provide the desired spring element.

Housing 40 is connected to the fabric of the glove or other garment. In this example, housing 40 is connected to fourchette 20. The fourchette is made of elastic material. A somewhat undersized hole is punched or cut in this material. The assembled tactile touchscreen selector 32 is then pushed through the hole from left to right. Housing 40 is provided with flange 48—which tends to arrest any further progress through the hole. Frictional forces alone may be sufficient to hold the assembly in place. However, in many applications, it is desirable to add an adhesive between the fourchette material (around the hole's perimeter) and flange 48 of housing 40.

FIG. 5 shows the assembly of FIG. 4 in an actuated state. In this case, the user has pressed conductive mesh 34 against the surface of a touchscreen. This action has propelled plunger 36 in the distal direction and caused tactile surface 44 to protrude from the rear of base 46. Tactile surface 44 presses into the user's fingertip 42, and this is easily perceived. Thus, the user is given positive tactile feedback as to when a "pick" has been made on the touchscreen.

It is possible to "tune" the characteristics of the tactile touchscreen selector so that the user just perceives the protrusion of tactile surface 44 when a "pick" has been made on the touchscreen. This can be done via changing the spring coefficient on the spring element (resilient collar 38 in this example).

In the example of FIGS. 4 and 5, the outer diameter of housing 40 (excluding flange 48) is about 8 mm (0.315 inches). The overall depth of the device (from left to right in FIGS. 4 and 5) is also about 8 mm. The device is thus quite small and easy to add in many suitable locations.

Figure 6:
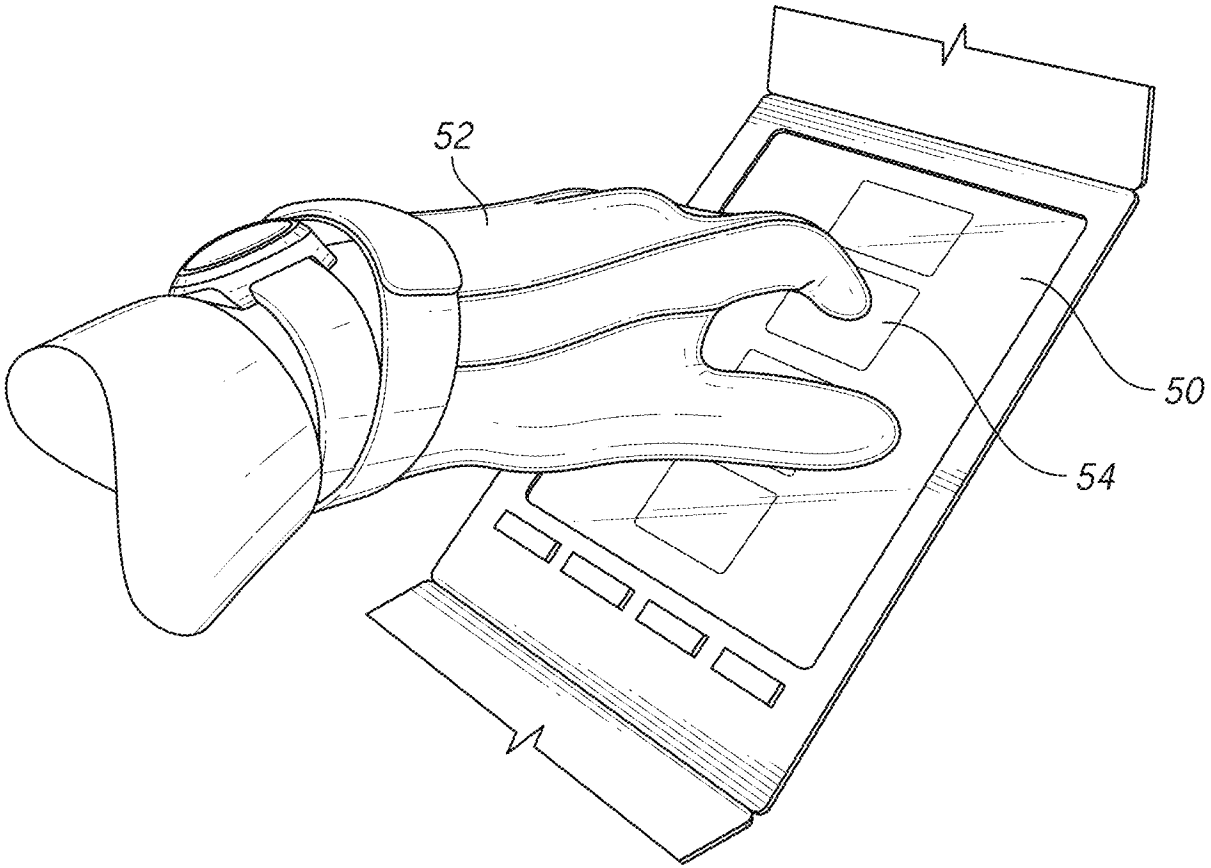
FIG. 6 is a perspective view, showing the user of a glove incorporating the invention to interact with a touchscreen.

FIG. 6 shows a glove 52 incorporating a tactile touchscreen selector being used to interact with touchscreen 50 and make a "pick" on a particular displayed icon 54. In this example the tactile touchscreen indicator is in the position shown in FIG. 3 (tip of the index finger). However, those skilled in the art will know that it is sometimes convenient to use multiple contact points with a touchscreen. Multiple points are used for zooming operations and for reorientation operations.

Figure 7:
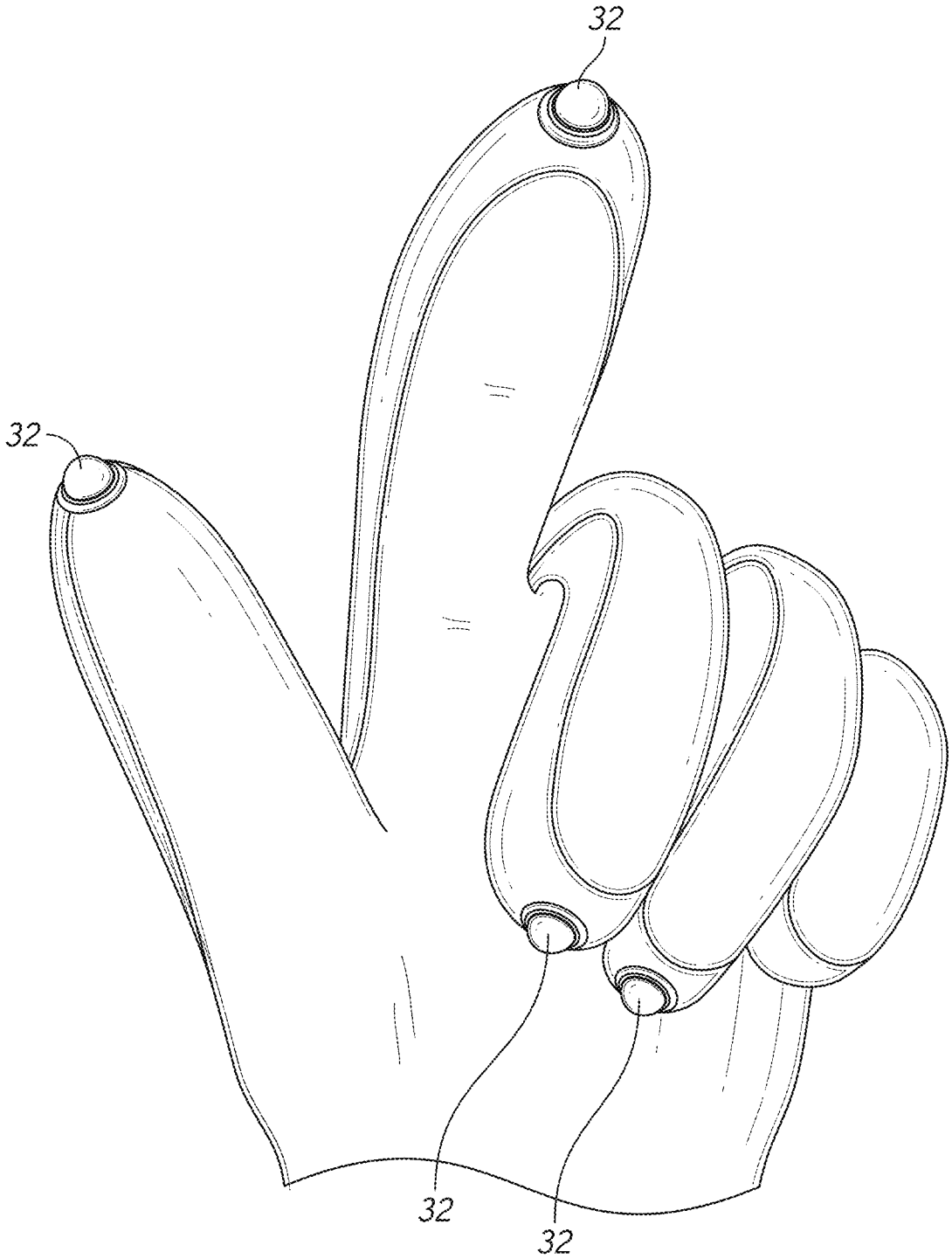
FIG. 7 is a perspective view, showing the incorporation of multiple touchscreen selectors on a single glove.

FIG. 7 shows another example in which four tactile touchscreen selectors 32 are included. These selectors are preferably placed in a position where the digit will naturally contact a touchscreen. These positions may need to be customized for some users. For instance, some users will prefer the tip of the thumb while other users will prefer the side of the thumb. It is possible to add the inventive selector by simply punching an undersized hole in the desired location and pressing the selector assembly through from the inside.

Figure 8:
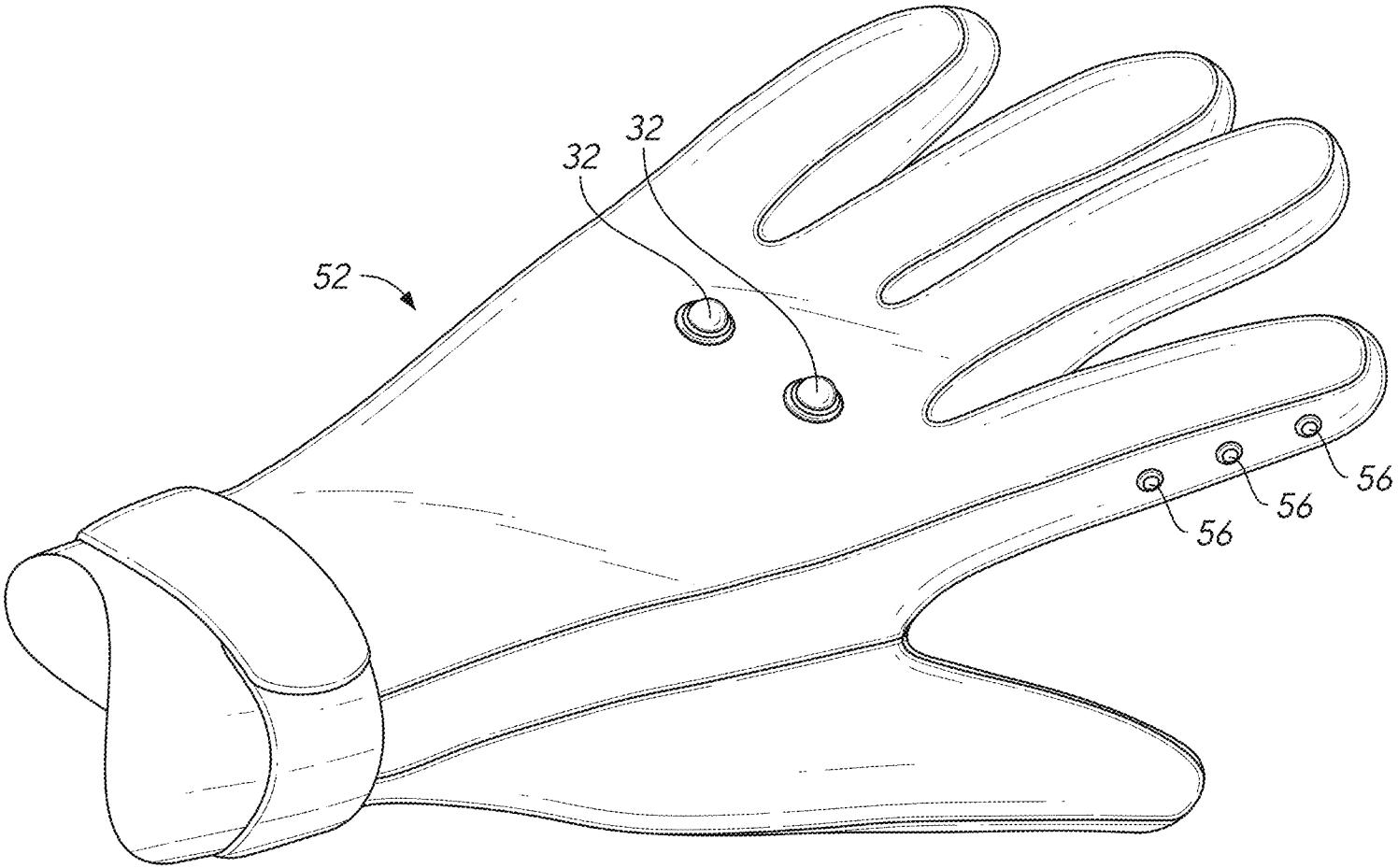
FIG. 8 is a perspective view, showing touchscreen selectors of differing sizes and in various locations on a glove.

FIG. 8 shows still another example. In this version, two tactile touchscreen selectors 32 (of the type shown in FIG. 4) have been added to the back trank of the glove. These allow selections to be made with the back of the hand (while unusual this is a method that is known in some aircraft). Smaller selectors can be provided in other locations. In the example of FIG. 8, three smaller selectors 56 are placed along the side of the index finger. These devices indicate to the pilot that the hand is properly positioned against a lateral stop (as in the case of some hand-on-throttle applications). The locations shown are exemplary as the inventive selector can be placed in many other locations. The reader should also bear in mind that a glove is only one type of garment that may be used to mount the inventive tactile touchscreen selector.

The gloves used in the illustrations are slip-on flight gloves. It is also possible to apply the present invention to pressurized gloves in which the cuff is sealed to a pressure suit. Returning to FIG. 4, those skilled in the art will realize that the seals between the fourchette and housing 40, as well as the seal between housing 40 and conductive mesh 38 can be made pressure tight (or in the alternative allow only a small leak rate).

The materials selected for the tactile touchscreen selector are significant, in that a conductive path should be maintained between conductive mesh 34 and the user. This can be done via fourchette 20 but it is more preferably done through housing 40 and base 46. In the version shown, the housing and the base are made from thin-walled aluminum. They could also be made from thermoplastic resin with a conductive additive. Plunger 36 can be made from a conductive material in order to ensure a conductive connection between tip 60 and the user's finger. Plunger 36 can be made from a thermoplastic resin with a conductive additive. Any of the relatively rigid components can also be made conductive via the addition of a conductive coating-such as nickel. The reader should bear in mind that in many instances the use of a conductive material for plunger 44 is unnecessary, since the other components 40, 46 will tend to remain in contact with the fingertip.

In some examples the inventive selector may not be used to interact with a touchscreen and may instead only provide tactile feedback. FIG. 8 provides a possible example. Selectors 56 along the side of the index finger need not be configured to interact with a touchscreen. In those examples, the use of a conductive material for any portion of the selector is unnecessary.

The inventors have in fact discovered that the use of an array of smaller selectors provides enhanced sensory perception of the nature and shape of external objects while a user is wearing a glove. It is generally not necessary for most of these selectors to have the ability to interact with a touchscreen or make selections on a touchscreen. The mechanical feedback of contact with an external object is sufficient. The inventors have thus focused on the provision of very small tactile nodes—preferably provided in arrays where enhanced sensory perception is desired.

Figure 9:
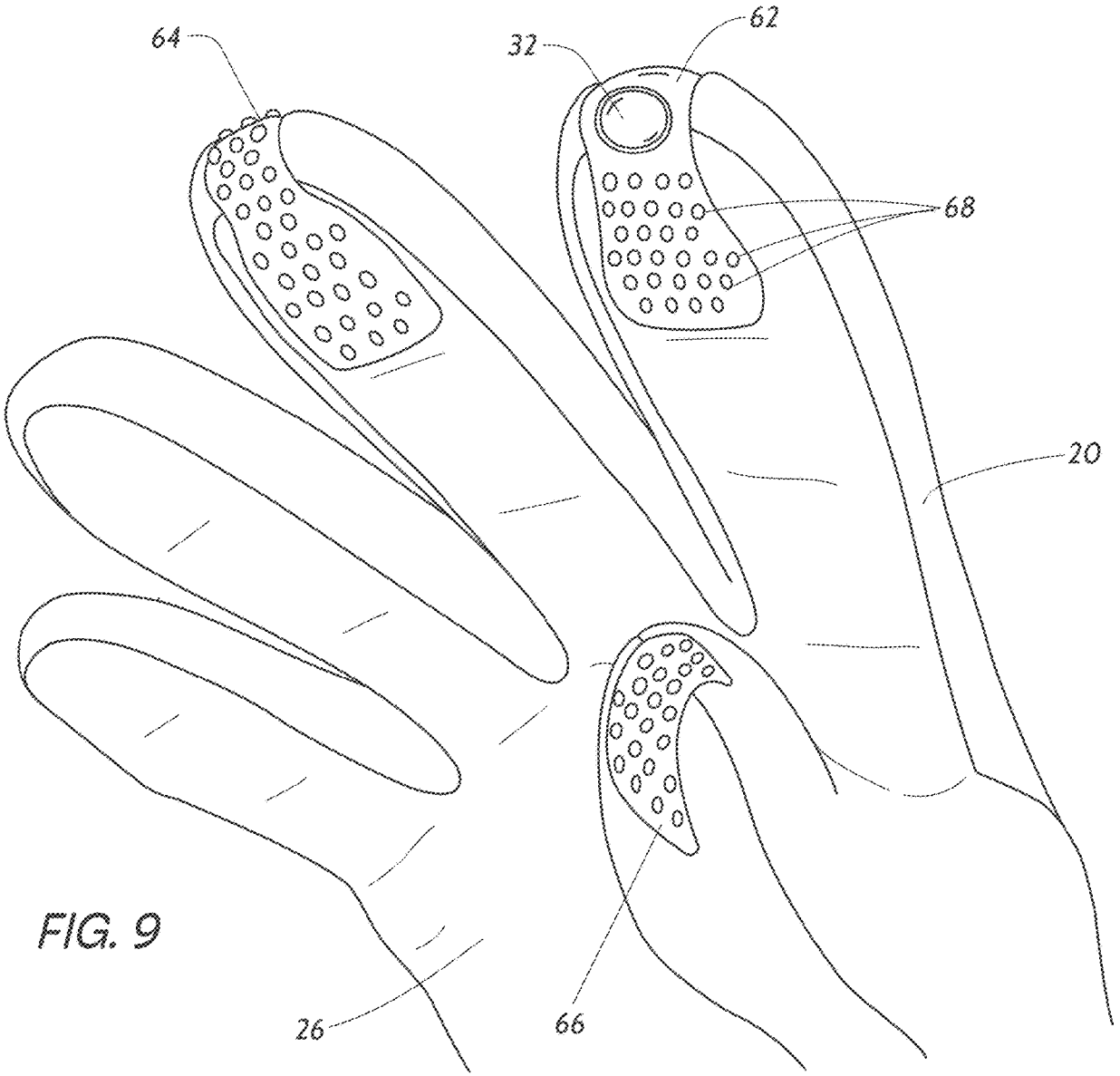
FIG. 9 is a perspective view, showing a glove incorporating various tactile inserts.

FIG. 9 illustrates an embodiment of this inventive approach. The glove shown in FIG. 9 is made using conventional techniques. In this example, it is an assembly of a palm trank 26, a fourchette 20, and a back trank. The invention uses panels that are incorporated in the glove's structure in areas where enhanced sensory perception is desired. In the example of FIG. 9, first finger insert 62, second finger insert 64, and thumb insert 66 are added to the glove. These inserts contain arrays of tactile nodes 68. One or more tactile touchscreen selectors 32 can also be provided as desired.

Figure 10:
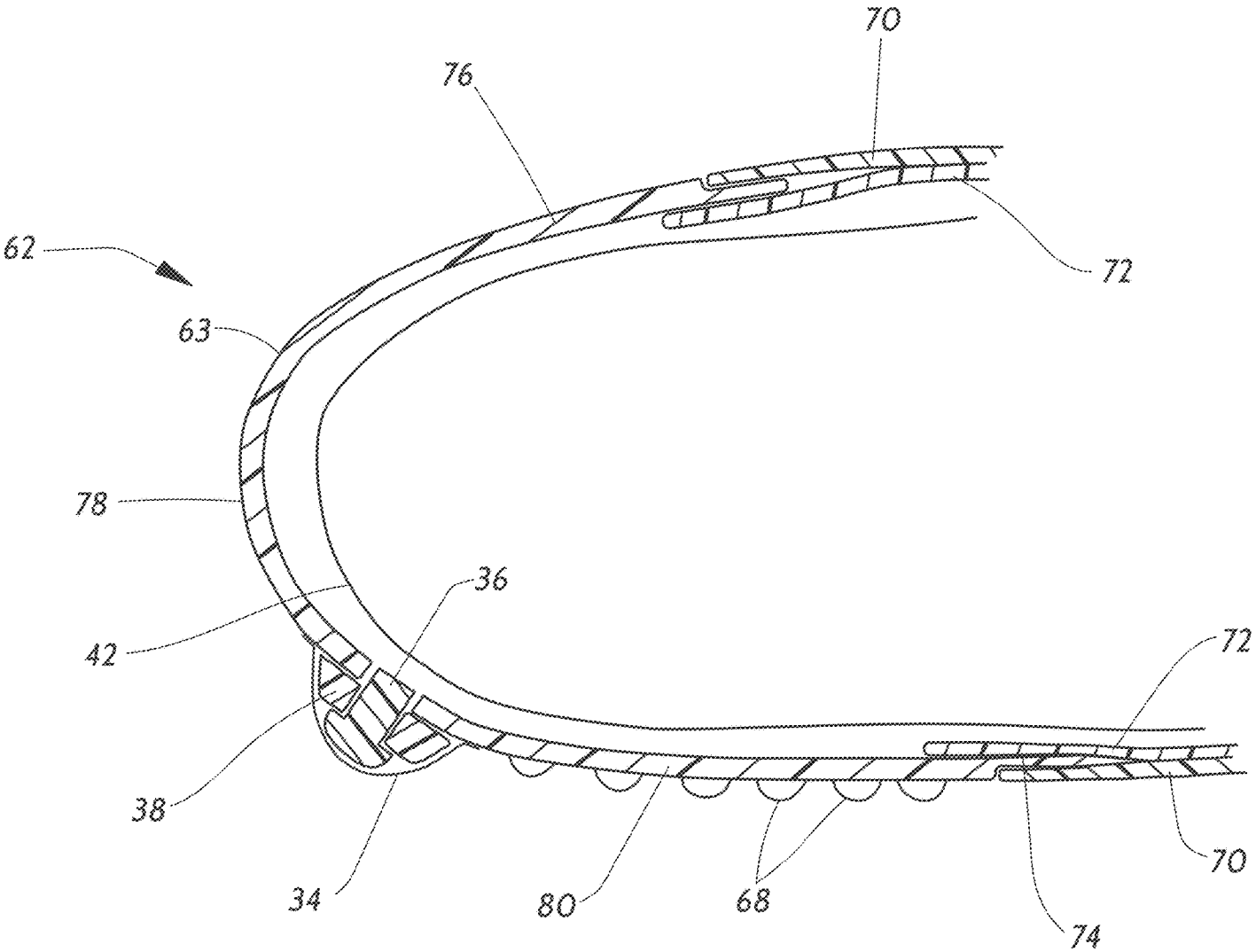
FIG. 10 is a section view, showing the internal structure of an exemplary insert.

FIG. 10 provides a section view through first finger insert 62. Wall 63 is a molded polymer shaped to curve around from upper portion 76, through tip portion 78, and down to lower portion 80. An attachment flange 74 is provided around the perimeter of the device. The attachment flange is inserted between the glove's outer layer 70 and its inner layer 72. An adhesive is used to bond the flange to the glove's layers. Stitching or other joining techniques may also be used.

The tactile selector is incorporated as part of the insert. Plunger 36 is positioned within an opening through the insert. Conductive mesh 35 lies over the plunger and is attached to the exterior surface of the wall 63. Resilient collar 38 surround the plunger and urges it outward and away from fingertip 42. An array of tactile nodes 68 are also provided on the insert. In this example, the array is provided on lower portion 80.

Figure 13:
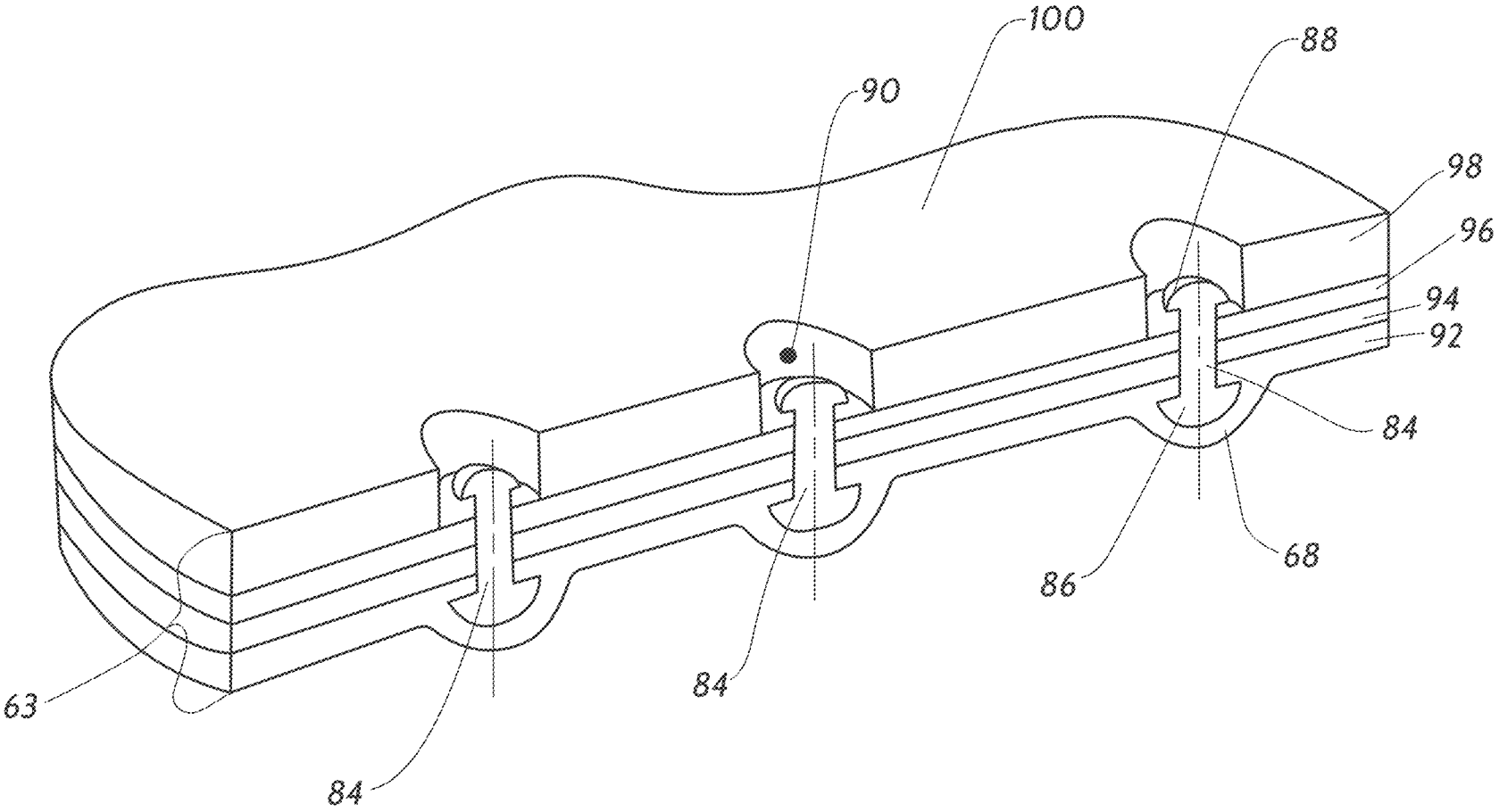
FIG. 13 is a sectioned perspective view, showing internal details of three sensory nodes in an array.

The internal details of the inventive tactile nodes are significant. FIG. 13 provides a sectional view through three of the nodes 68 in the array. The reader should note that the hatching lines customarily used in a section view are omitted to avoid visual clutter. The hatching lines are not believed to be needed because the section plane is readily apparent in the perspective view.

The section is taken through the middle of three rods 84. Each rod 84 is a radially symmetric object having a surface interface on its outward end and a finger interface on its inward end. In the example shown, the surface interface includes surface interface cap 86 on its outward end ("outward" meaning toward the outer surface of the glove insert) and the finger interface includes a finger interface cap 88 on its inward end. A relief 90 surrounds each finger interface cap. The rods 84 are oriented approximately transversely to the outer surface. In this context the phrase "approximately transversely" means within thirty degrees of perpendicular to the outer surface.

Multiple different layers of material are used to create wall 63 for the example shown. Outer layer 92 is molded over surface interface cap 86 and incorporates the protruding hemispherical surface of the node. This connects the surface interface to outer layer 92. Second layer 94 lies just inside outer layer 94. The cylindrical middle portion of rod 84 passes through a hole in the second layer. Third layer 96 lies just inside second layer 94. The rod's middle portion also passes through a hole in the third layer. Inner layer 98 lies inside third layer 96. Inner layer 98 includes a relief 90 providing clearance around the finger interface—in this example providing clearance sufficient for finger interface cap 88.

In the preferred embodiments all four layers are made of a flexible polymer. Outer layer 92 is made of a polymer having a medium modulus of elasticity. Second layer 94 is made of a polymer having a higher modulus of elasticity than the outer layer. Third layer 96 is made of a polymer having a modulus of elasticity that is lower than the moduli of the outer and second layers. Inner layer 98 is made of a polymer having a modulus of elasticity that is higher than the modulus of the third layer but lower than the moduli of the outer and second layers.

Figure 14:
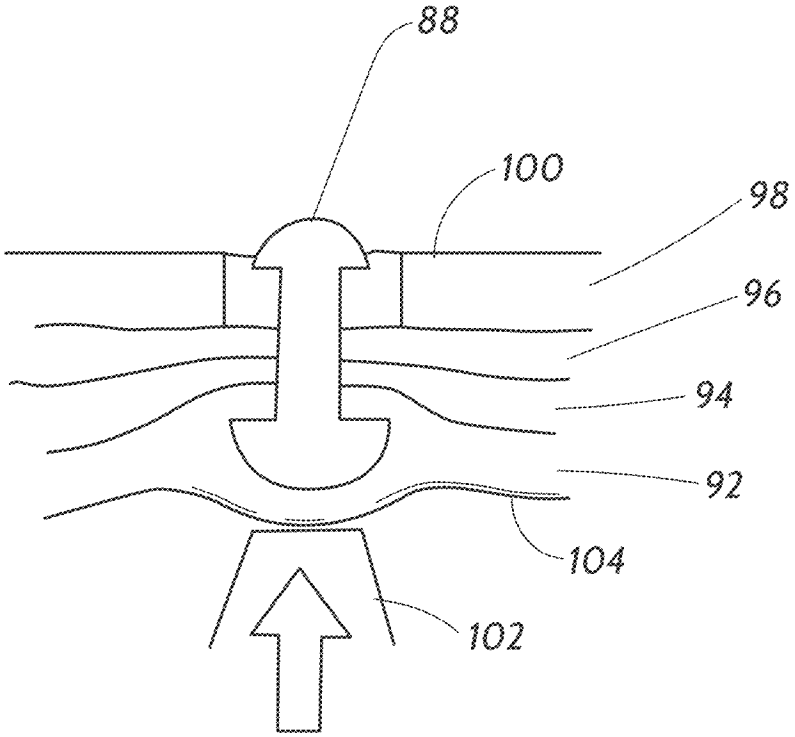
FIG. 14 is a sectioned elevation view, showing the operation of a single sensory node.

FIG. 14 shows an elevation view through a single tactile node when an external object 102 is pressing against the node's exterior. The compression of the layers 92,94,96,98 allows finger interface cap 88 to protrude further inward than inner surface 100 and create a small point of contact with the user's finger. The user is able to feel this small point of contact much easier than would be the case with a broad pressure spread over the exterior of the finger tip.

By using an array of many such nodes, when the glove inert contacts an external object the user is given multiple points of contact from multiple protruding finger interface caps 86. This allows the user to more easily perceive the shape and nature of the external object. Thus, the provision of such arrays of tactile nodes enhances the functionality of the glove.

Figure 11:
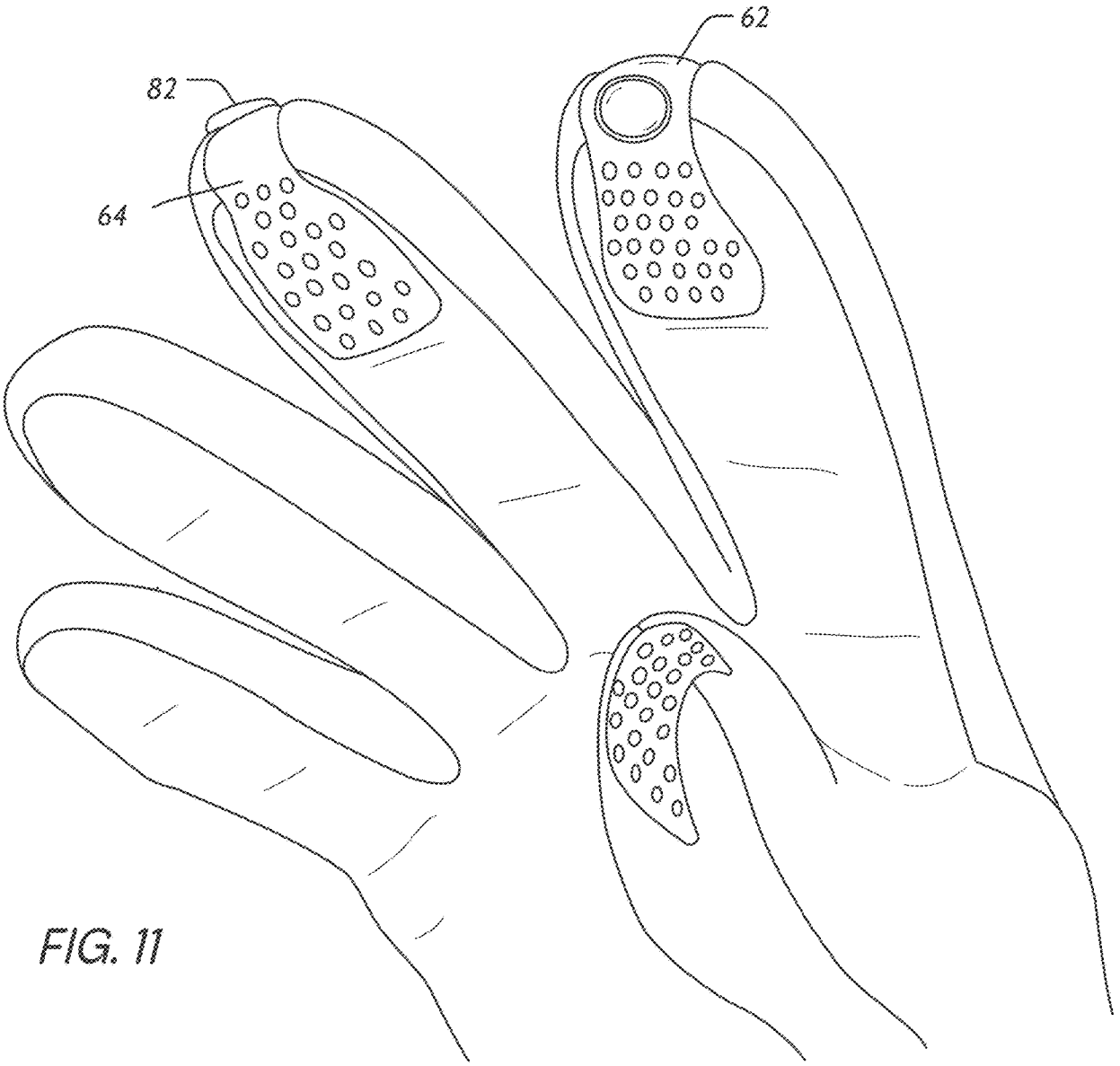
FIG. 11 is a perspective view, showing a glove having an insert with a nail protrusion.
Figure 12:
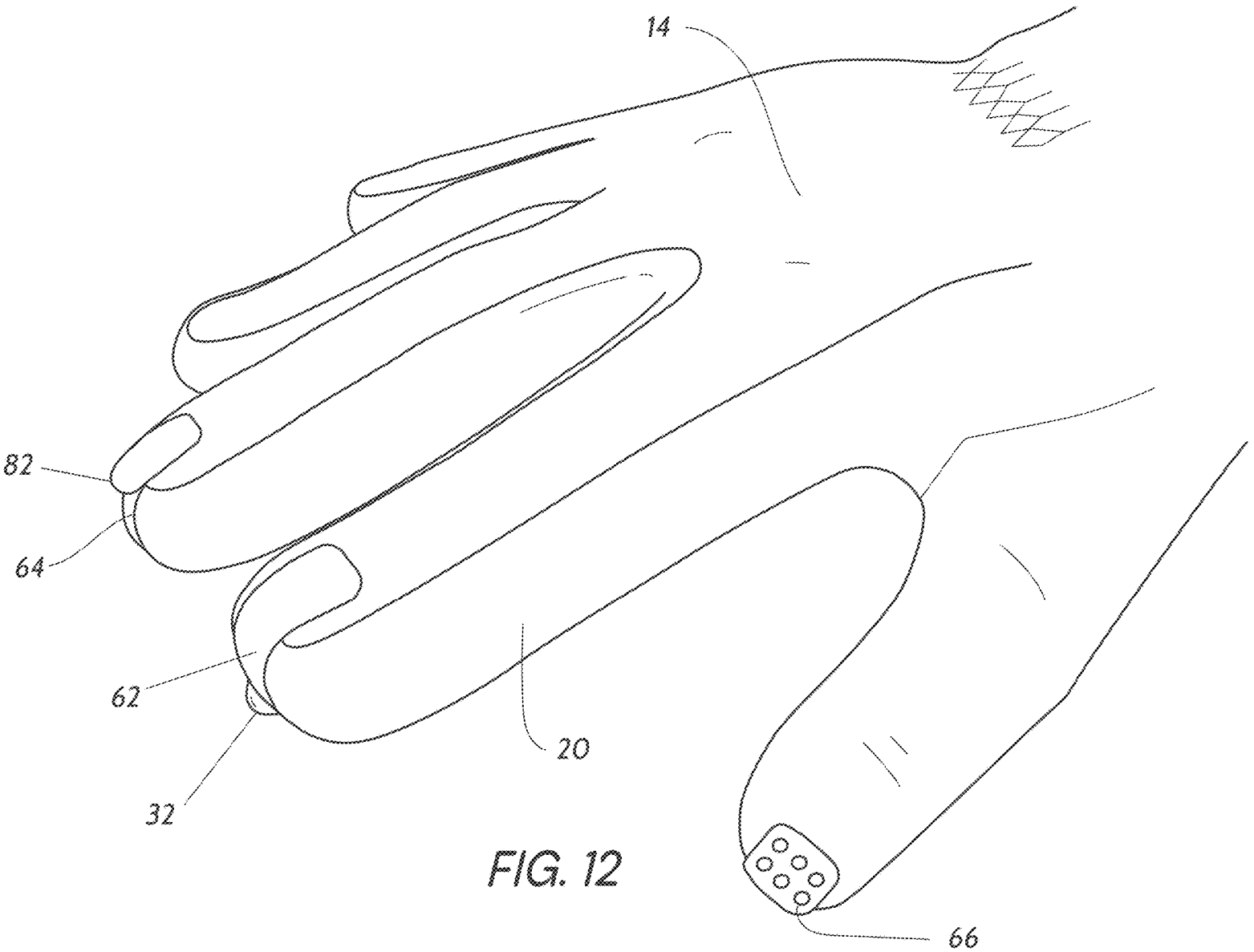
FIG. 12 is a perspective view, showing the glove of FIG. 11 from a different vantage point.

Additional features can be provided to allow the user more flexibility in gripping and manipulating external objects. One disadvantage of using gloves is the inability to use a fingernail to "hook" a small edge when removing a lid or performing a similar operation. FIGS. 11 and 12. FIG. 11 shows a second finger insert 64 with an incorporated nail protrusion 82. The tactile nodes have been omitted in the region beneath nail protrusion 82. A smooth surface is provided in that area so that the user can slide the finger tip along an object until the nail protrusion catches on the object—just as is commonly done using a human fingernail without a glove.

FIG. 12 shows the same embodiment from above bank trank 14. The reader will note how first finger insert and second finger insert 64 include portions wrapping over the top of the fingertips and into the back trank 14. This allows the inserts 62,64 to be connected to the palm trank, the fourchette, and the back trank—enhancing structural integrity.

Second finger insert 64 includes nail protrusion 82 extending forward from its upper portion. This positions the nail extrusion to act like a human fingernail. Other protrusion shapes can be used as well, and these can be altered to suit a particular application. As one example, a pointed and rigid protrusion is often needed for firearm disassembly and reassembly. Soldiers performing these operations in cold environments typically remove the gloves-risking frostbite. The provision of an appropriate protrusion allows these operations to be conducted with the gloves remaining on, while the provision of tactile node arrays provides a suitably sensitive feel through the gloves.

The distribution of nerve receptor sites throughout the body is uneven. Not surprisingly, greater concentrations of nerve receptor sites exist where they are most useful. It is advantageous to provide tactile node arrays that are mapped to regions of the hand where the nerve receptor concentrations are highest.

The distribution of nerve receptor sites has been mapped through two-point discrimination testing. In this method, calipers are used to determine the minimum distance between two contact points that a user can accurately perceive as two points of contact rather than a single point of contact. On the underside of the tip of the index finger, an average user can perceive two points of contact with a separation distance of 3 to 5 mm. Near the heel of the hand, the average user will require 7 to 12 mm of separation in order to perceive two contact point. In contrast, the average user needs over 40 mm of separation to perceive two contact points on the upper lateral arm.

The hand obviously contains a higher concentration of nerve receptor sites, but the concentration varies considerably even within the hand. It is impractical to provide tactile node arrays across all the exterior surfaces of a glove. Thus, it makes sense to "map" the provision of tactile node arrays to areas of dense nerve receptor sites where they will be most useful. Tactile node arrays should be prioritized to the underside of the fingertips and the inward-facing surfaces of the thumb. Priority should be given to the distal portions of the fingers over the proximal portions. Priority should be given to the distal and inward facing surfaces of the palm.

The inventive embodiments can include many other features, and combinations of features, including the following:

1. Rather than providing a conventional glove with one or more inserts, the entire glove can be made of flexible polymer layers so that the entire glove has the structure of an insert;
2. One or more layers of an insert can be cloth or other woven material rather than a polymer material;
3. The rods in the tactile nodes can be made of metal or can be a suitable rigid polymer; and
4. The surface interface can be any suitable attachment feature rather than a dome-shaped cap. A simple thread can be used as an attachment feature.

The preceding description contains significant detail, but it should not be construed as limiting the scope of the invention but rather as providing illustrations of the preferred embodiments of the invention. Thus, the scope of the invention should be fixed by the claims ultimately drafted, rather than by the examples given.

Having described my invention, I claim:

1. A glove providing tactile feedback to a user, comprising:
(a) an insert integrated into said glove, said insert including an inner surface, an outer surface, an outer layer, and an inner layer;
(b) said insert including a plurality of tactile nodes, each including,
(i) a rod oriented approximately transversely to said outer surface,
(ii) a surface interface cap on a first end of said rod,
(iii) a finger interface cap on a second end of said rod,
(iv) said surface interface cap being attached to said outer layer, and
(v) said finger interface cap being movable between an undeflected position wherein said finger interface cap lies outward of said inner surface and a second position wherein said finger interface cap protrudes inward beyond said inner surface.

2. The glove as recited in claim 1, wherein said surface interface caps have a larger cross section than said rods.

3. The glove as recited in claim 2, wherein said finger interface caps have a larger cross section than said rods.

4. The glove as recited in claim 1, wherein said surface interface caps are embedded within said first layer.

5. The glove as recited in claim 1, wherein said insert includes a second layer inside of said outer layer and outside of said inner layer.

6. The glove as recited in claim 5, wherein said insert includes a third layer inside of said second layer and outside of said inner layer.

7. The glove as recited in claim 6, wherein said insert further comprises a nail protrusion.

8. A glove providing tactile feedback to a user, comprising:
(a) an inner surface, an outer surface, an outer layer, and an inner layer;
(b) a plurality of tactile nodes, each including,
(i) a rod oriented approximately transversely to said outer surface,
(ii) a surface interface on a first end of said rod,
(iii) a finger interface on a second end of said rod,
(iv) said surface interface being attached to said outer layer, and
(v) said finger interface being movable between an undeflected position wherein said finger interface lies outward of said inner surface and a second position wherein said finger interface protrudes inward beyond said inner surface.

9. The glove as recited in claim 8, wherein said surface interfaces have surface interface caps with a larger cross section than said rods.

10. The glove as recited in claim 9, wherein said finger interfaces have finger interface caps with a larger cross section than said rods.

11. The glove as recited in claim 8, wherein said surface interfaces are embedded within said first layer.

12. The glove as recited in claim 8, wherein said glove includes a second layer inside of said outer layer and outside of said inner layer.

13. The glove as recited in claim 12, wherein said glove includes a third layer inside of said second layer and outside of said inner layer.

14. The glove as recited in claim 13, wherein:
(a) said second layer has a higher modulus of elasticity than said outer layer;
(b) said third layer has a modulus of elasticity that is lower than said modulus of elasticity of said outer layer; and
(c) said inner layer has a modulus of elasticity that is higher than said third layer but lower than said second layer.

15. A glove providing tactile feedback to a user, comprising:
(a) an insert integrated into said glove, said insert including an inner surface, an outer surface, an outer layer, and an inner layer;
(b) said insert including a tactile node, wherein said tactile node includes,
(i) a rod oriented approximately transversely to said outer surface,
(ii) a surface interface on a first end of said rod,
(iii) a finger interface on a second end of said rod,
(iv) said surface interface being attached to said outer layer, and
(v) said finger interface being movable between a rest position wherein said finger interface lies outside of said inner surface and a deflected position wherein said finger interface protrudes inward from said inner surface.

16. The glove as recited in claim 15, wherein said surface interface has a larger cross section than a cross section of said rod.

17. The glove as recited in claim 16, wherein said finger interface has a larger cross section than said rod.

18. The glove as recited in claim 15, wherein said surface interface includes a cap embedded within said first layer.

19. The glove as recited in claim 15, wherein said insert includes a second layer inside of said outer layer and outside of said inner layer.

20. The glove as recited in claim 15, wherein said insert includes a third layer inside of said second layer and outside of said inner layer.

* * * * *